United States Patent [19]

Shankman

[11] Patent Number: 4,796,311

[45] Date of Patent: Jan. 10, 1989

[54] CHEMICAL AND/OR RADIATION DECONTAMINATION

[76] Inventor: Jay Shankman, 48 Castle La., Holtsville, N.Y. 11742

[21] Appl. No.: 37,208

[22] Filed: Apr. 10, 1987

[51] Int. Cl.[4] ..... A47K 3/22; A61N 5/00

[52] U.S. Cl. ..... 4/596; 4/663; 52/35; 128/897

[58] Field of Search ..... 4/597, 661-663; 128/1 R, 1 B, 365-366; 134/201; 252/630, 631; 52/34, 35, 234

[56] References Cited

U.S. PATENT DOCUMENTS

| | | | |
|---|---|---|---|
| 3,587,118 | 1/1971 | Compton | 4/597 X |
| 3,623,284 | 11/1971 | Meyer | 128/1 R X |
| 4,359,789 | 11/1982 | Roberts | 4/663 X |
| 4,655,235 | 4/1987 | Scott, Jr. | 128/1 R X |
| 4,675,129 | 6/1987 | Baatz et al. | 252/631 |
| 4,675,923 | 6/1987 | Ashley | 128/1 R X |

*Primary Examiner*—Stuart S. Levy
*Assistant Examiner*—Steven M. DuBois
*Attorney, Agent, or Firm*—Leonard Belkin

[57] ABSTRACT

An intake facility and method for use with the emergency room of a hospital for processing the victims of a chemical disaster who may have suffered chemical contamination. Separate rooms are provided for surface removal of contamination in a way which permits the victims to be monitored before being moved into a triage room for evaluation and then into the emergency room. Separate provision is made to handle trauma victims. Arrangements and procedures are provided to prevent access to the emergency room of those persons carrying contamination which could "dirty" the emergency room.

2 Claims, 2 Drawing Sheets

CHEMICAL AND/OR RADIATION DECONTAMINATION

BACKGROUND OF THE INVENTION

This invention relates to a chemical decontamination facility and method, and more particularly to a self-contained chemical decontamination facility and method for use with, or as part of, emergency rooms in hospitals.

The chemical accident which occurred in Bhopal, India on Dec. 3, 1984 killed more than 2,000 people and injured 200,000. As a result of that accident, there has been increased interest in the state of preparedness of medical facilities in this country and elsewhere to meet an emergency of that magnitute.

A recent study involving 44 major hospitals in a major metropolitan area having a substantial number of chemical processing and production plants revealed that more than half the hospitals had no formal treatment methods for emergencies from accidents in chemical plants.

Aside from the question of having adequately trained personnel to meet such a contingency, it was found that there was little or no special facilities within or associated with the emergency room to handle even relatively small disasters of this type, let alone any emergency from a major chemical plant disaster.

As a result of the Bhopal tragedy, efforts have been made to increase the capability of hospital emergency rooms to meet chemical disasters. For example, some hospitals have been installing in their emergency rooms sophisticated electronic equipment, such as a gas chromatograph/mass spectrometer to aid in identifying the nature and degree of the contamination, deluge showers to remove surface contaminating materials, and triage rooms to evaluate the patients being brought in under the emergency conditions.

While the steps taken as described above reflect movement in the right direction, what has been done up to now and has been contemplated falls far short of what is needed in the event of an actual emergency. A difficult problem to deal with is how to avoid secondary contamination of the hospital facilities, particularly the emergency room, when the hospital is overwhelmed with large numbers of persons suffering from contamination in a disaster, and, typically without adequate knowledge of the nature of the contamination when the first patients are brought into the emergency room.

SUMMARY OF THE INVENTION

The present invention concerns an arrangement in which a hospital is provided with facilities capable of processing large numbers of chemical contamination victims of a disaster while at the same time preserving the integrity of the hospital facilities, that is, without causing a secondary decontamination of the hospital emergency and other rooms which could result under present conditions should such a disaster strike a community.

In accordance with a preferred embodiment of this invention, there is provided an intake facility for use with the emergency room of a hospital for processing the victims of chemical contamination prior to delivery of said victims as patients to the emergency room for treatment. This facility, which could be designed as a mobile or prefabricated unit for attachment to the outside of the emergency room, would comprise an external dock for accepting exclusively as patients the victims of a major chemical disaster, a contaminated intake area within the facility isolated from the emergency room for receiving said patients, and a trauma room communicating with the contaminated intake area for receiving and permitting treatment of trauma patients. In parallel with the trauma room for receiving patients free of trauma there is provided a first room for bagging the garments of the patients, an ejector room for spraying patients emerging from the bagging room with water under pressure of at least 75 psi mixed with detergent to remove adherent surface contamination, a wash down room for receiving patients emerging from the ejector room for deluging the patients with a large flow of water to remove water and detergent remaining from the ejector room, a drying room for blow drying patients emerging from the wash down room, and a triage room for examining patients emerging from the drying room. An important feature of the invention is having the openings into and out of the bagging, ejector, wash down and drying rooms arranged so that all of the patients in those rooms can be monitored from the triage room. In addition, the triage and trauma rooms are connected directly to the emergency room, thereby isolating the emergency room from any chemical decontamination.

It is therefore a principal object of this invention to provide a facility for handling victims of a chemical contamination disaster in such a way as to permit them to be treated in the emergency room of a hospital without exposing the emergency room to chemical contamination.

Other objects and advantages of this invention will become obvious from the following detailed description of preferred embodiments of this invention.

DETAILED DESCRIPTION OF THE PREFERRED EMBODIMENTS

Figure 1:
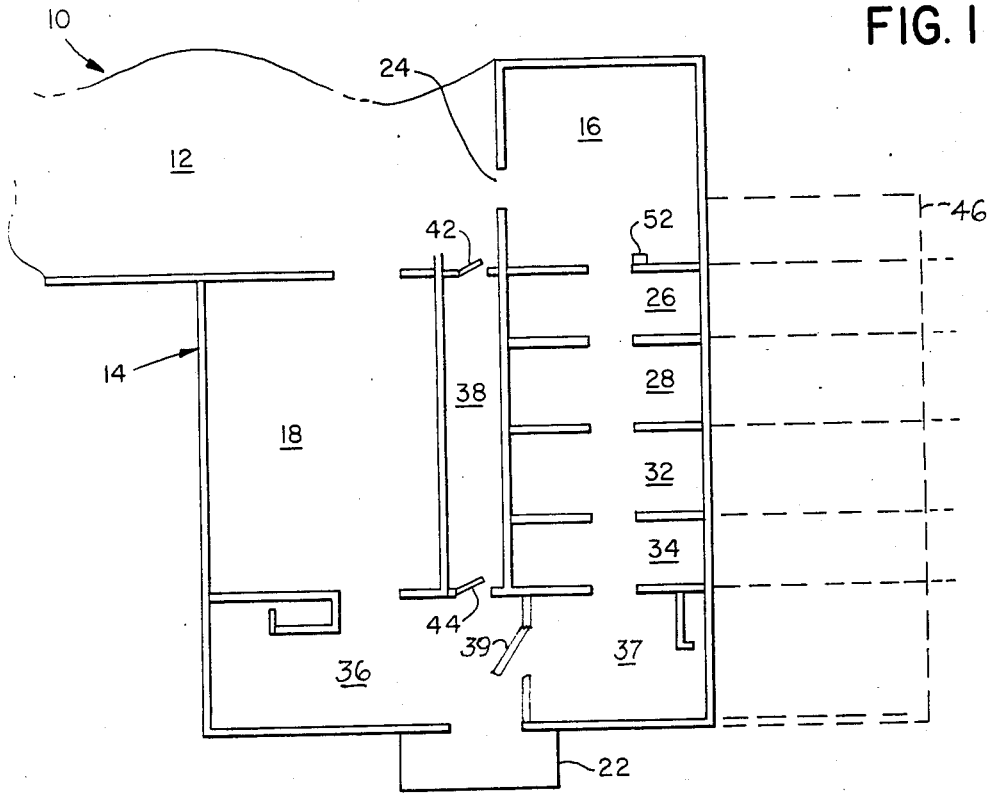
FIG. 1 is a plan view in schematic form showing the layout of a facility embodying the principles of this invention.

Referring to FIG. 1, there is shown a portion of a hospital 10 having an emergency room 12 in which normally patients are brought directly in who require emergency treatment of one type or another. In accordance with this invention there is provided a facility 14 which is, in this instance, an addition to the hospital, but also could be a mobile or prefabricated unit brought up to hospital 10 and attached in the manner illustrated. In facility 14, triage and trauma rooms, 16 and 18, respectively, are contiguous with emergency room 12 with the remaining structure extending to the ambulance dock 22 illustrated. With facility 14 as shown, it is understood there would be a separate entrance (not shown) to emergency room 12 for patients other than those suspected of chemical contamination.

Facility 14 consists of triage room 16 with direct access to emergency room 12 through a doorway 24, a row of processing rooms made up of a drying room 26, a deluge room 28, an ejector room 32, and a bagging room 34, plus an intake room 36 and an undressing room 37, trauma room 18 previously mentioned, and outside ambulance dock 22.

In addition, it will be noted that there is a hall 38 between intake room 36 and emergency room 12. This hall is controlled by locked doors 42 and 44 at both ends. Only a handful of special personnel have keys to these doors because of the potential of moving contaminants directly from intake room 36 to emergency room 12. Hall 38 is not normally in use. A door 39 insures privacy for those underssing in room 37.

Among the features of this invention is the arrangement of the processing rooms 26, 28, 32,and 34 with their entries such that a medical technician in either triage room 16 or intake room 36 is able to monitor what is going on in all of those rooms.

Another feature of the invention is that the layout permits the addition, as shown in phantom, of an extension 46 which can be added duplicating all of the processing rooms, as many times as is appropriate, therefore making it possible to size the facility to meet particular local conditions.

Figure 2:
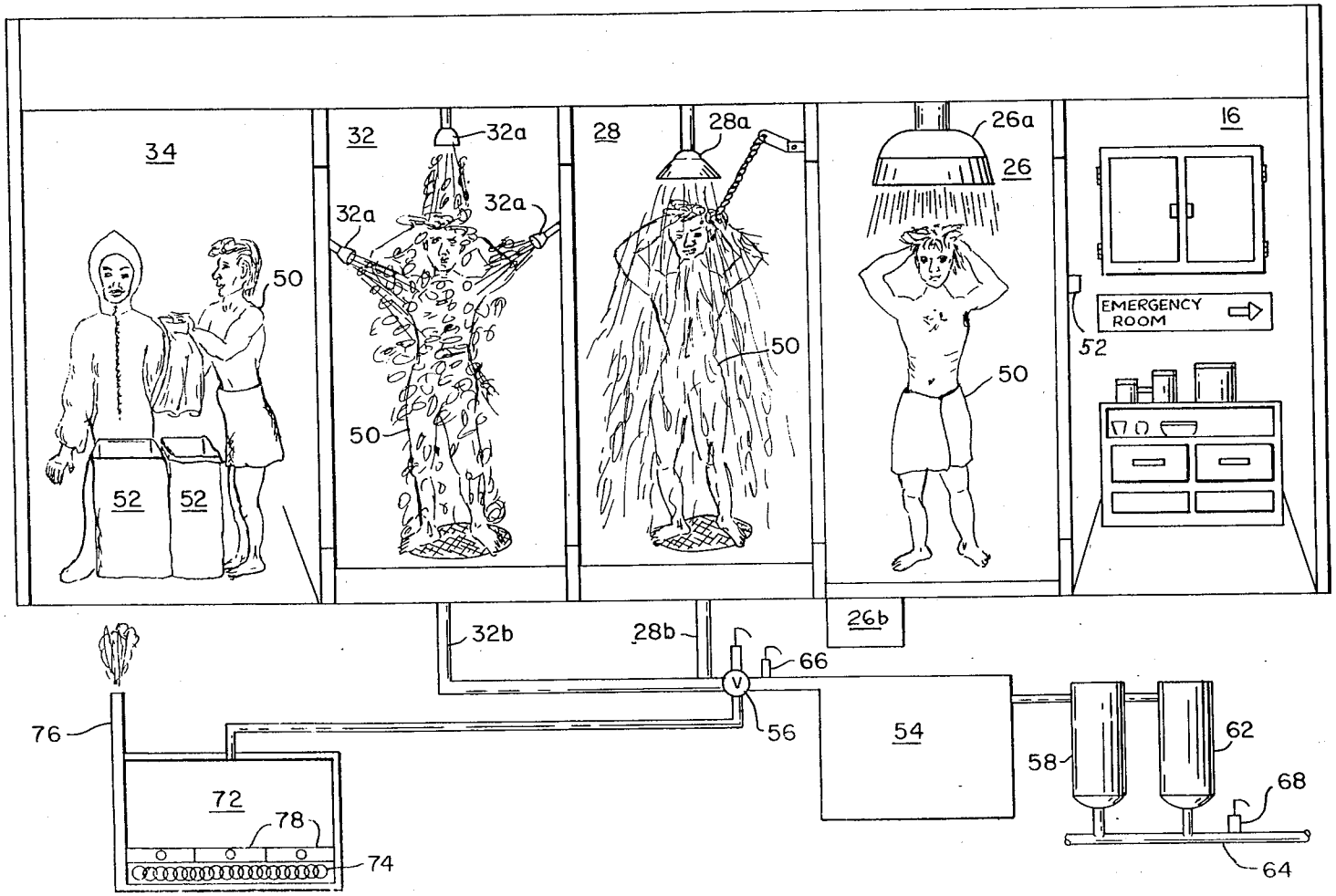
FIG. 2 is a schematized elevation view of bagging, ejector, wash down, drying and triage rooms illustrated in FIG. 1.

For details of the processing rooms, reference is made to FIG. 2. In bagging room 34 victim 50 removes all of his clothing and other parephanalia which are deposited in containers 52. Victim 50 then steps into ejector room 32 where he is sprayed with water mixed with a detergent at a very high pressure, for example, at about 60–75 psi, from spray heads **32*a*** in order to dislodge any surface contamination including any oil or oily contaminants which require the detergent for proper removal.

Victim 50 then moves into deluge room 28 where he is subject to a deluge (that is, large amounts) of water from a deluge head **28*a* at still higher pressure, i.e., 75–120 psi in order to remove all residue from the outside surfaces of the victim's body. It should be noted that in the event of a nuclear contamination, the victim may skip ejector room 32 as a detergent is not required. In drying room 26, a blast of hot air from blower outlet 26*a* receiving hot air under pressure from blower 26*b* is employed to dry the victim completely. Overriding controls of the fluids delivered in the rooms just described are located outside of this area and are under the control of a technician to insure that each victim receives adequate treatment in this portion of the facility. The controls 52 may be located in triage room 16** where the technician is able to observe activities going on in these rooms.

One of the important aspects of this invention is the ability to treat waste water from rooms 28 and 32 to permit its reintroduction into the environment. For this purpose there are a pair of drains **28*b* and 32*b* from deluge and ejector rooms 28 and 32, respectively emptying into a holding tank 54 through a two way valve 56 whose purpose will be described below. From holding tank 54, the waste water may be passed through two stage activated charcoal filters 58 and 62 and discharged through line 64** into a sewer system (not shown) or otherwise into the environment. This arrangement meets current E.P.A. and local authority standards.

A test valve 66 located between valve 56 and holding tank 54 enables monitoring of contaminated water. An additional test valve 68 in line 64 permits testing of the waste water prior to return to the environment. Such testing is designed to meet regulatory requirement. Filters 58 and 62, is understood in the act, may also be tested at appropriate intervals.

The arrangement for disposing of waste water as just described may be converted to a radiation decontamination mode of operation by re-routing waste water containing radioactive components into burn-off tank 72 using valve 56. Heating coils 74 will be turned on in such an event to burn off steam from the waste water through a steam relief chimney 76 leaving the radiation contaminated residue in cleanout traps 78.

Victim 50, now a patient, then goes into triage room 16 where he is evaluated before he is forwarded into the emergency room or other specialized treatment area. Patient 50, once he is in triage room 16, is no longer in a position where he can contaminate the emergency or other rooms of the hospital which are to be kept clear or free of such contamination.

In intake room 36, where victim 50 if first brought, he is examined for the existence of trauma, for example, a life threatening seizure, heart attack, bleeding, shock, etc., and in the event it appears that the victim is traumatized, he is moved directly into trauma room 18 where he can be treated. Room 18 is a dirty or contaminated room but is provided with facilities (not shown) to accomplish what is normally accomplished in room 26 to 34 as described above. It is anticipated that only a small fraction, based upon experience, of the victims would be traumatized. The technicians active in intake room 36 and trauma room 18 treating the patient would be wearing garments designed to protect them from contamination. Such garments, such as so-called Tyvek suits, are known in the art and commercially available. Where one or more extensions 46 are present, then the worker in triage room 16 monitoring processing rooms 26 to 34 would be able to monitor also those rooms in the extensions 46.

The whole purpose of the arrangement just described is to insure that the victims being brought into the hospital or other medical facility do not spread contamination to areas which should be maintained free of such contamination, and yet at the same time to be able to process large numbers of such victims without causing second line exposure to overwhelm the hospital and staff and other patients and visitors in the emergency department.

The arrangement described in connection with FIGS. 1 and 2 is designed to make maximum use of space in order to produce such a facility with the least possible cost.

Figure 3:
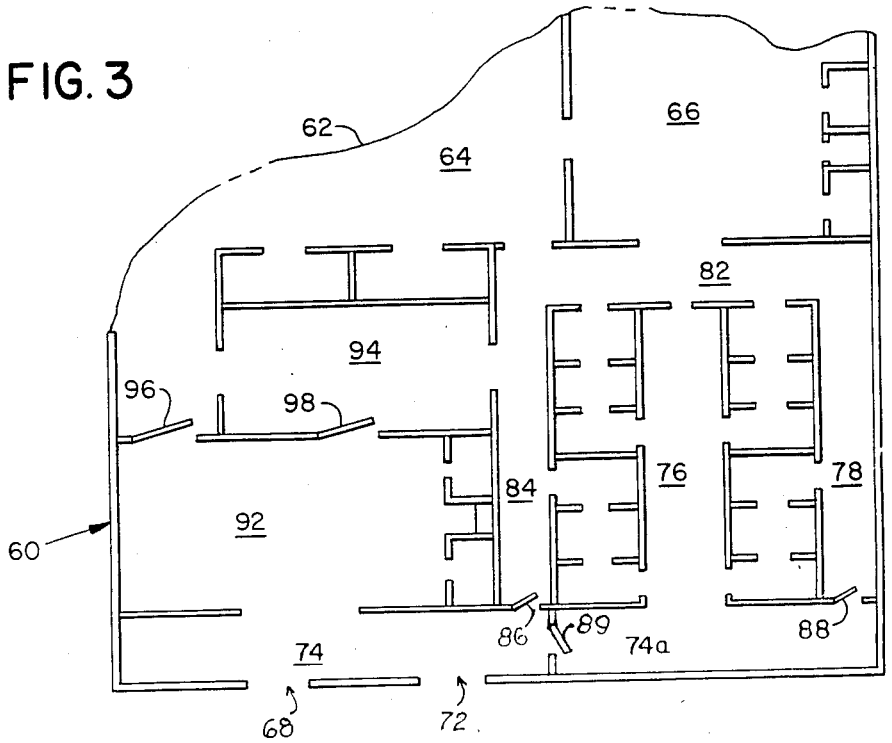
FIG. 3 shows an alternative layout of a facility incorporating the principles of this invention suitable for handling large numbers of victims.

For a hospital in an area which requires the capacity to handle even larger numbers of victims, such as in a large density urban community with large chemical production facilities nearby, the arrangement shown in FIG. 3 may be employed.

Illustrated is the decontamination facility 60 built into the corner of a hospital 62 having emergency room 64 and a triage room 66. It will be seen that there are two ambulance docks 68 and 72 with a common intake room 74 which can contain a bagging area **74*a* as shown. Off a hall 76 extending from room 74 is located a bank of processing rooms of the type shown in FIG. 2 for detergent ejection, water deluge, and drying. Each of the drying rooms exits into "clean" hallways 78, 82, and 84 which lead to emergency room 64. Locked doors 86 and 88 with limited personnel access seal off the clean hallways to prevent contamination from dirty areas. A door 89 separates areas 74 and 74*a* for the purpose of privacy for persons undressing in baffing area 74*a***.

Extra personnel are required to monitor the activities within the various processing rooms.

On the opposite side of hallway 84 are a dirty waiting room 92 and trauma room 94 sealed off by locked doors 96 and 98.

Personnel working in the decontamination facilities 14 and 60 illustrated in FIGS. 1 and 3, respectively, would be functioning under strict policies and procedures in order to maintain the integrity of the adjacent emergency rooms.

It is thus seen that there has been provided an improved and unique approach to the handling of victims of chemical disasters with adequate protection of the hospital emergency room facilities from contamination.

While only certain preferred embodiments of this invention have been described it is understood that many variations of the invention are possible without departing from the principles of this invention as defined in the claims which follow.

What is claimed is:

1. An intake facility added on to and in combination with the emergency room of a hospital, said facility having an entrance separate from and in addition to the entrance to said emergency room for receiving and processing the disaster victims of chemical contamination prior to delivery of said victims as patients to said emergency room for treatment, comprising, external dock means for accepting exclusively as patients said victims, a contaminated intake area within said facility isolated from said emergency room for receiving said patients, trauma room means communicating with said contaminated intake area for receiving and permitting treatment of trauma patients, means in parallel with said trauma room means for receiving patients free of trauma comprising first room means for bagging the garments of the latter said patients, ejector room means for spraying patients emerging from said bagging room means with water under pressure of at least 75 psi mixed with detergent to remove adherent surface contamination, wash down room means for receiving patients emerging from said ejector room means for deluging said patients with a large flow of water to remove water and detergent remaining from said ejector room means, drying room means for blow drying patients emerging from said wash down room means, and triage room means for examining patients emerging from said drying room means, the openings into and out of said bagging, ejector, wash down and drying rooms means being aligned so that all of the patients in said room means can be viewed from said triage room means, means for connecting said triage and said trauma room means directly to said emergency room, thereby isolating said emergency room from said chemical decontamination, means for treating the waste water from said ejector and wash down room means to permit its reintroduction into the environment, said treating means including holding tank means for receiving said waste water, and filter means for removing contaminents in said water prior to return to the environment.

2. The facility of claim 1 having valve means to by pass waste water containing radioactive components directly from said wash down room means into means for burning off steam from said waste water and leaving the radiation contaminated residue.

* * * * *